United States Patent [19]

McCauley

[11] 4,347,838

[45] * Sep. 7, 1982

[54] FOOT MASSAGER

[76] Inventor: Kerry McCauley, 9607 E. Sturgeon Valley Rd., Vanderbilt, Mich. 49795

[ * ] Notice: The portion of the term of this patent subsequent to Apr. 22, 1997, has been disclaimed.

[21] Appl. No.: 128,501

[22] Filed: Mar. 10, 1980

Related U.S. Application Data

[63] Continuation-in-part of Ser. No. 909,762, May 26, 1978, Pat. No. 4,198,962.

[51] Int. Cl.[3] ..... A61H 1/00

[52] U.S. Cl. ..... 128/33; 128/57; 128/67; 272/96

[58] Field of Search ..... 15/110, 188, 215; 128/24 R, 24.3, 28, 33, 44, 51-57, 60, 62 R, 64, 67-69, 80 R, 80 D, 581, 582, 205.25, 38, 39; 272/96

[56] References Cited

U.S. PATENT DOCUMENTS

| | | | |
|---|---|---|---|
| D. 101,862 | 11/1936 | Fehn | 128/57 |
| 2,438,249 | 3/1948 | Mattison | 128/57 |
| 2,752,915 | 7/1956 | Riblet | 128/57 |
| 2,765,786 | 10/1956 | Blong | 128/25 B |
| 2,895,470 | 7/1959 | Reiter | 128/25 B |
| 3,083,709 | 4/1963 | Lengsheld | 128/57 |
| 4,010,743 | 3/1977 | Fitzsimmons | 128/57 |
| 4,198,962 | 4/1980 | McCauley | 128/33 |

*Primary Examiner*—Richard C. Pinkham

*Assistant Examiner*—Carl Moy

*Attorney, Agent, or Firm*—James M. Deimen

[57] ABSTRACT

The invention comprises an improved foot massage device having a plurality of rotatable balls forming a generally convex surface. The balls are mounted on parallel bars in turn supported in a frame suitable for placement on the floor. A detachable electric vibrator is mounted within the frame to impart a vibrating and massaging action to the balls through the frame. The user merely places his foot upon the massager and moves the foot back and forth to have a gentle massaging and vibrating action imparted to the foot. Mounted on the frame is a generally vertical conical spindle that is rotatable and formed to impart the massaging and vibrating action to the arch of the foot when placed in contact with the spindle.

The vibrator is conveniently detachable from the underside of the foot massager. Attachable to the vibrator are a general massage attachment and a special spinal roller attachment.

In an alternate version the rows of balls are staggered to provide a lateral squeezing and stretching action to the foot simultaneous with the up and down longitudinal squeezing and stretching as the foot is moved over the balls. In this version the balls may be separate or in the form of beaded rollers. The beaded rollers may be mounted on the parallel bars or formed with integral stub shafts inserted in socket holes in the frame.

6 Claims, 10 Drawing Figures

FIG. 1
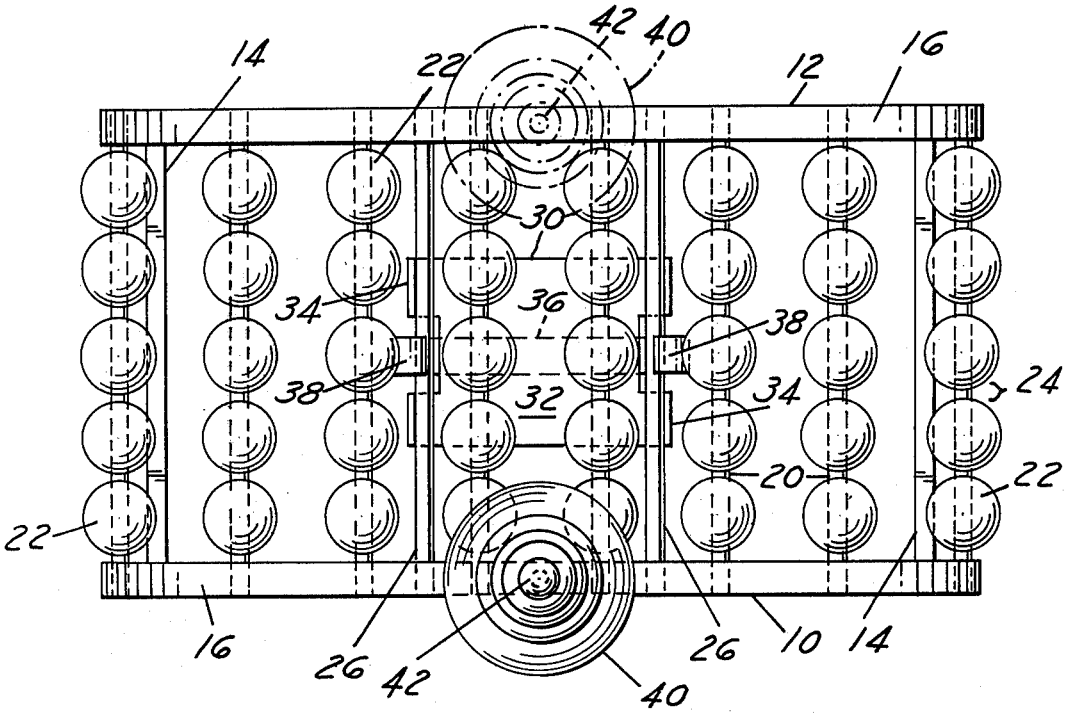
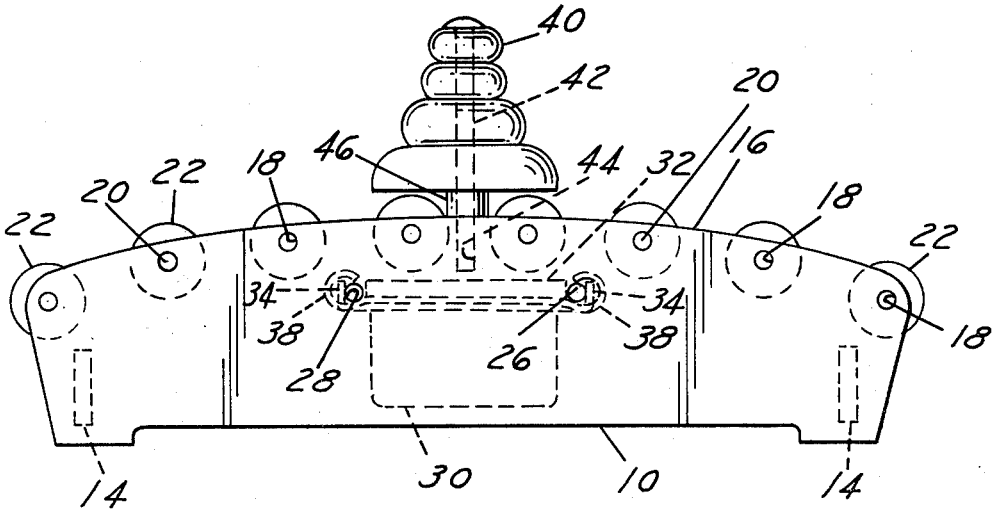
FIG. 2

FIG. 5
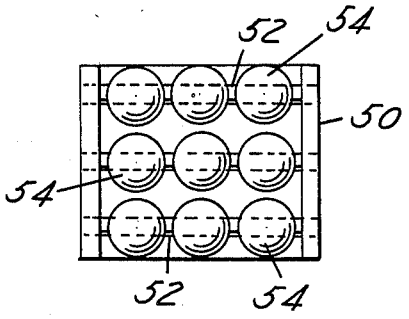
FIG. 4
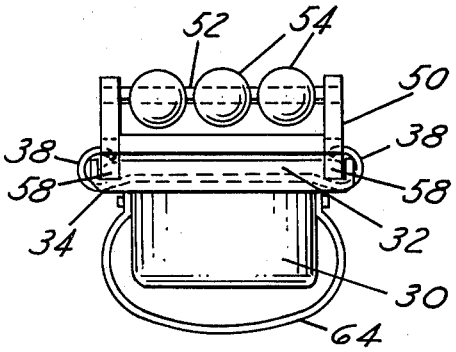
FIG. 3
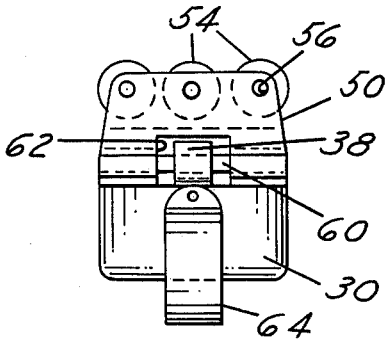
FIG. 7
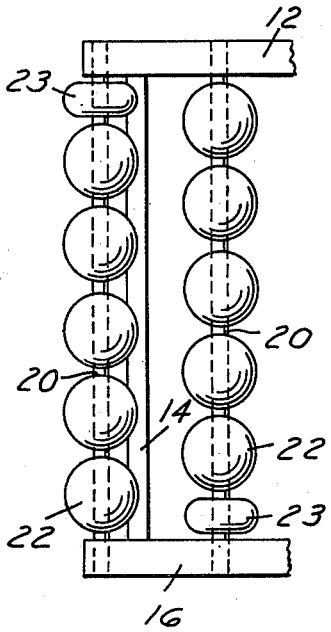
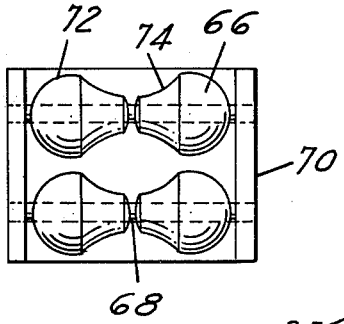
FIG. 6
FIG. 8
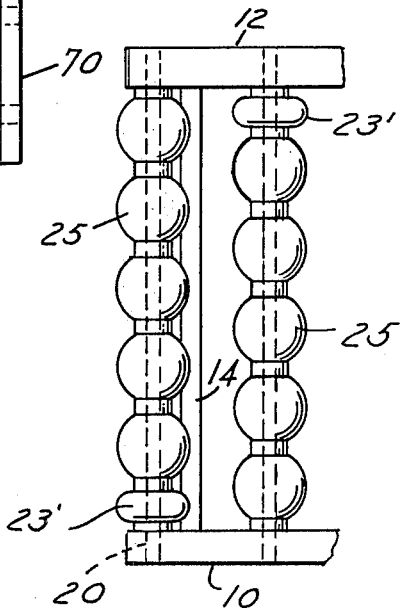

FOOT MASSAGER

BACKGROUND OF THE INVENTION

This application is a continuation-in-part of application Ser. No. 909,762, filed May 26, 1978, now issued U.S. Pat. No. 4,198,962, dated Apr. 22, 1980.

Massaging devices for the whole body and for the foot are known in the prior art. For example, U.S. Pat. Nos. 1,643,040, 2,175,614 and 3,205,887 disclose whole body massagers generally in the form of a couch having a plurality of rollers or balls supporting the user. The latter two patents disclose powered apparatus directly connected to and driving the rollers in a reciprocating manner. Similarly, foot massagers are exemplified by U.S. Pat. Nos. 2,072,959, 2,269,707 and 2,895,470. These patents disclose a variety of shapes for the rollers. A directly connected electric motor for imparting a reciprocating action to the rollers in a direction substantially parallel to the axis of the rollers is disclosed in U.S. Pat. Nos. 2,269,707 and 2,895,470 discloses rollers disposed to impart a massaging action to the top and sides of a foot. The massager of U.S. Pat. No. 2,438,249 discloses a plurality of rollers supported in a frame to provide a generally convex surface for massaging the back muscles and other parts of the body.

However, none of the prior art noted above discloses a vibratory drive means connected through the frame of the device to impart a vibrating and massaging action to the foot. Nor is a detachable vibrator for alternative use with other ball or roller assemblies for massaging other parts of the body disclosed.

SUMMARY OF THE INVENTION

The invention comprises an improved foot massage device having a plurality of rotatable balls forming a generally convex surface. The balls are mounted in rows on parallel rods in turn supported in a frame suitable for placement on the floor. A detachable electric vibrator is mounted within the frame to impart a vibrating and massaging action to the balls through the frame. The user merely places his foot upon the massager and moves the foot back and forth to have a gentle massaging and vibrating action imparted to the foot. Mounted on the frame is a generally vertical conical spindle that is rotatable and formed to impart the massaging and vibrating action to the arch of the foot when placed in contact with the spondle.

The vibrator is conveniently detachable from the underside of the foot massager. Attachable to the vibrator are a general massage attachment and a spinal roller attachment. Vibrational energy is imparted to an attachment through the frame of the attachment in a manner similar to the foot massager. The invention therefore provides a very simple and economical construction for a foot massager and attachments.

In an alternate version the rows of balls are staggered to provide a lateral squeezing and stretching action to the foot simultaneous with the up and down longitudinal squeezing and stretching as the foot is moved over the balls. In this version the balls may be separate or in the form of beaded rollers.

DESCRIPTION OF THE DRAWINGS

FIG. 1 is a top view of the foot massager;

FIG. 2 is a side view of the foot massager showing the electric vibrator attached thereto;

FIG. 3 is an end view of the general massage attachment showing the electric vibrator attached thereto;

FIG. 4 is a side view of the general massage attachment showing the electric vibrator attached thereto;

FIG. 5 is a top view of the general massage attachment without the electric vibrator attached;

FIG. 6 is a top view of the spinal roller attachment;

FIG. 7 is a partial top view of an alternate staggered ball form of the foot massager;

FIG. 8 is a partial top view of the foot massager showing beaded rollers positioned for staggered ball action;

DESCRIPTION OF THE PREFERRED EMBODIMENTS

Figure 9:
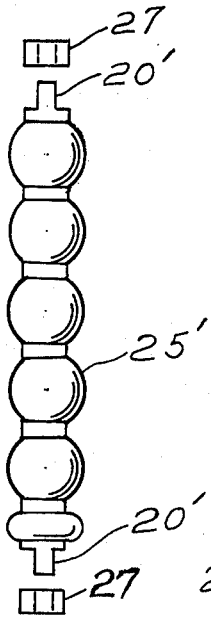
FIG. 9 is an exploded view of a roller with an integral shaft and antifriction bushings; and, FIG. 10 is a partial top view of the foot massager showing beaded rollers with integral shafts and antifriction bushings.

In FIGS. 1 and 2 the massager comprises a frame having two side members 10 and 12 and two end pieces 14 joining the side members to form a generally rectangular structure. Adjacent the arcuate upper edges 16 of the side members 10 and 12 are a plurality of holes 18 with rods 20 inserted therein in parallel to join the side members together. The end pieces 14 and rods 20 are suitably permanently fastened to the side members 10 and 12 with adhesive or other fastener means.

Mounted on the rods 20 are a plurality of balls 22. The balls are freely rotatable on the rods with sufficient clearance 24 between the balls to prevent any interference therebetween. Two additional rods 26 extend between the side members 10 and 12 and are fastened permanently thereto in holes 28. The rods 26 provide support and transmission means for a detachable vibrator 30 located at the center of the frame as shown. The vibrator 30 comprises an electric vibratory drive motor and a mounting frame 32 attached thereto by suitable conventional adhesive or mechanical fastening means. A suitable motor is Model Serial Number TN 65012 available from the Coil Company of America, 702-902 Washington, Northvale, N.J. 07647.

The mounting frame 32 has four grips 34 adapted to engage the rods 26 as shown and a symmetric spring clip 36 having hooks 38 adapted to clamp about the rods 26 as shown. Thus, the vibrator 30 can be snapped tightly to and within the massage frame or detached therefrom conveniently.

Mounted on side member 10 and extending upwardly therefrom is a generally conical form 40 for massaging the arch of the foot. The form 40 may be made from a single piece or a plurality of discs freely rotatable on a central pin 42. The pin 42 is inserted and fastened in a hole 44 in the side member 10 with a spacer 46 to prevent interference of the form 40 with the balls 22 directly below. Although the form 40 is made up of a plurality of convex surfaces of revolution, the maximum radii of the convex surfaces as measured from the pin 42 form a slightly concave conical surface of revolution to generally conform to the arch of the foot. As an alternative, the maximum radii of the convex surfaces as measured from the pin 42 can form a slightly convex conical surface of revolution.

A second conical form 40 may be mounted on the side member 12 as shown ghosted in FIG. 1. Massaging of the arches of both feet can thereby be accomplished without reversal of the foot massager position on the floor.

The massager is used by placing it on the floor and placing one foot on the balls 22. Movement of the foot back and forth longitudinally on the massager produces a gentle and beneficial massaging action on the bottom of the foot. Additional massaging action is provided by attaching the vibrator 30 to the frame. The vibrational energy is transmitted through the frame to the rotatable balls providing an invigorating action. With the vibrator attached the massager is most effective when placed on a carpeted floor. By placing the arch of the foot against the conical form 40 the invigorating massaging action is directly transmitted to the arch.

In FIGS. 3, 4 and 5 an optional general massage attachment for the vibrator 30 is shown. The general massage attachment is gripped in the hand and used to apply a beneficial massaging and vibratory action to various parts of the body.

The general massage attachment includes a frame 50 having a plurality of rods 52 extending thereacross to support a plurality of freely rotatable balls 54 thereon. The rods 52 are permanently attached in holes 56 in the sides of the frame 50. Extending from the frame 50 are four stubs 58 adapted to engage the grips 34. The two stubs 58 on each side are separated by a linking portion 60 and an indentation 62 thereabove. The linking portion 60 provides engagement means and the indentation 62 provides clearance means for the hooks 38. A hand strap 64 is attached to the vibrator 30 to assist the user in gripping the device when using the general massage attachment or the spinal attachment described below. The strap 64 is flexible and therefore will not interfere with the attachment of the vibrator 30 within the foot massager frame and placement on a floor.

The spinal roller attachment of FIG. 6 is also adapted to attach to the vibrator mounting frame 32. As shown, the spinal attachment includes a plurality of rollers 66 freely rotatble on rods 68 in turn attached to a frame 70 in a manner similar to the general massage attachment. The frame 70 is formed to engage the vibrator frame 32 with stubs in the same manner as the general massage attachment as shown in FIGS. 3 and 4. The rollers 66 comprise surfaces of revolution having both convex 72 and concave 74 portions and are positioned on the rods 68 as shown to effect a superior massaging action to the spinal area.

In FIG. 7 an alternate embodiment of the massager includes discs 23 of the same diameter and one half the width of the balls 22. The discs 23 are located on opposite ends of adjacent rods 20 of the foot massager. In this manner the balls 22 on adjacent rods 20 are positioned in staggered relationship as shown. Movement of the foot over the staggered balls causes a lateral squeezing and stretching action to be imparted to the foot simultaneous with the up and down longitudinal squeezing and stretching. A more effective massaging action is thereby imparted to the foot than with aligned balls or smooth rollers. The staggered ball relationship may also be incorporated in the general massage attachment of FIGS. 3 through 5 in a manner similar to that shown in FIG. 7.

In FIG. 8 beaded rollers 25 are substituted for the balls 22 and discs 23 of FIG. 7. The rollers 25 are reversed end for end during assembly on adjacent rods 20 to provide the staggered ball relationship of FIG. 7 and the massaging action imparted thereby.

For balls or beaded rollers of the same diameter as in FIG. 1, the distance between the side members 10 and 12 and the length of the rods 20 are slightly greater to accommodate the half width discs 23 in FIG. 7 and 23' in FIG. 8. In working prototypes of the foot massager, 15/16" diameter balls mounted on rods spaced 1" on center has been found suitable and effective for the desired massaging action.

Figure 10:
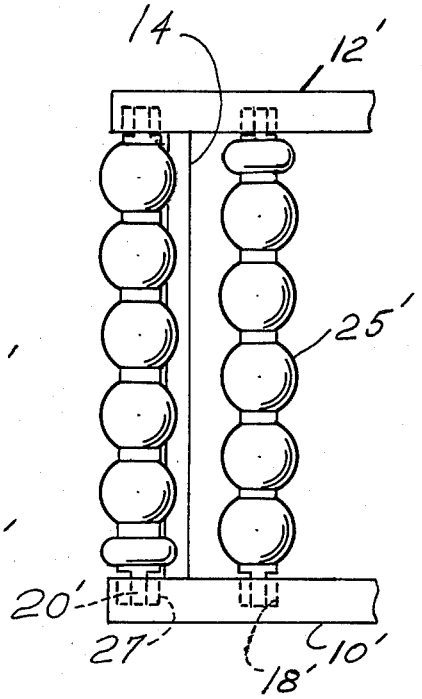

In FIGS. 9 and 10 an alternate form of construction for the rollers is shown. The beaded rollers 25 are formed with stub shafts 20' extending from the ends of the rollers. The stub shafts 20' fit into plastic antifriction bushings 27 which in turn are inserted into holes 18' in the side members 10' and 12'. The integral stub shafts are preferably formed integral with the wooden rollers. This construction eliminates the need for metal shafts with a substantial weight and cost saving, resulting in important mail order and shipping savings.

I claim:

1. A foot massager comprising a supporting frame, a plurality of non-cylindrical beaded rollers rotatably attached to the frame to dispose the beaded rollers into a generally convex arcuate massaging surface and positioned to place the beads in staggered relation to the beads of the next adjacent roller, and a rotatable spindle attached to the frame and extending above the convex arcuate massaging surface, said rotatable spindle being substantially formed as a non-cylindrical surface of revolution.

2. The foot massager of claim 1 wherein the rotatable spindle is substantially formed as a convex truncated conical surface of revolution.

3. The foot massager of claim 1 wherein the rotatable spindle is substantially formed as a concave truncated conical surface of revolution.

4. The foot massager of claims 1, 2 or 3 wherein two spindles are mounted on opposite sides of the frame.

5. The foot massager of claim 1 wherein at least one roller is formed with a stub shaft extending therefrom and the frame is formed with a socket to engage the stub shaft.

6. The foot massager of claim 5 wherein an antifriction bushing engages the stub shaft and socket.

* * * * *